US010159874B1

(12) United States Patent
Lin

(10) Patent No.: US 10,159,874 B1
(45) Date of Patent: Dec. 25, 2018

(54) LUMINOUS BALL

(71) Applicant: BLACKSTAR CORP., New Taipei (TW)

(72) Inventor: Wei-Hung Lin, New Taipei (TW)

(73) Assignee: BLACKSTAR CORP., New Taipei (TW)

( * ) Notice: Subject to any disclaimer, the term of this patent is extended or adjusted under 35 U.S.C. 154(b) by 0 days.

(21) Appl. No.: 15/870,772

(22) Filed: Jan. 12, 2018

(51) Int. Cl.

| | |
|---|---|
| ***A63B 43/06*** | (2006.01) |
| ***A63B 43/00*** | (2006.01) |
| ***H05B 33/08*** | (2006.01) |
| *A63B 69/00* | (2006.01) |
| *A63B 37/12* | (2006.01) |

(52) U.S. Cl.
CPC ..... *A63B 43/06* (2013.01); *A63B 43/008* (2013.01); *H05B 33/0842* (2013.01); *A63B 69/0002* (2013.01); *A63B 2037/125* (2013.01); *A63B 2207/02* (2013.01)

(58) Field of Classification Search
CPC . A63B 43/06; A63B 43/008; A63B 2037/125; A63B 2207/02
See application file for complete search history.

(56) References Cited

U.S. PATENT DOCUMENTS 1,631,317 A * 6/1927 Fox ..... A63B 37/00 156/213
3,011,048 A * 11/1961 O'Brien ..... A63B 43/06 362/208
3,458,205 A * 7/1969 Douglas ..... A63B 43/06 156/228
5,388,825 A * 2/1995 Myers ..... A63B 43/06 473/570
5,403,000 A * 4/1995 Woosley ..... A63B 43/06 273/DIG. 24
6,142,894 A * 11/2000 Lee ..... A63B 43/00 446/397
6,719,653 B1 * 4/2004 Nesbitt ..... A63B 37/02 473/600
7,140,972 B2 * 11/2006 Redwine ..... A63B 43/06 473/280
8,727,919 B1 * 5/2014 Gentile ..... A63B 43/06 473/570
8,882,617 B2 * 11/2014 Kume ..... A63B 37/00 473/600

(Continued)

*Primary Examiner* — Steven Wong
(74) *Attorney, Agent, or Firm* — Li & Cai Intellectual Property (USA) Office

(57) ABSTRACT

A luminous ball is provided, including a sphere, at least one covering spliced to wrap the sphere, at least one seam formed on an edge of the covering, a plurality of thread apertures disposed at two sides of the seam, at least one thread penetrating the plurality of thread apertures to stitch the edge of the covering between the two sides of the seam, and a light-emitting device disposed in the sphere. The light-emitting device includes a light-emitting unit, a power unit, and an electrical insulating unit breaking an electrical connection between the light-emitting unit and the power unit. The electrical insulating unit is removable. The electrical connection between the light-emitting unit and the power unit is provided when the electrical insulating unit is removed such that lights emitted by the light-emitting unit penetrate the sphere and are visible through the seam and the thread apertures.

12 Claims, 13 Drawing Sheets

(56) References Cited

U.S. PATENT DOCUMENTS

| | | | | |
|---|---|---|---|---|
| 9,279,557 | B2 * | 3/2016 | Su | F21V 23/009 |
| 9,518,728 | B2 * | 12/2016 | Lin | F21V 33/008 |
| 9,776,048 | B2 * | 10/2017 | Lin | A63B 43/06 |
| 9,821,196 | B2 * | 11/2017 | Lin | A63B 43/06 |
| 2001/0049311 | A1 * | 12/2001 | Lewis | A63B 43/06 473/570 |
| 2004/0102265 | A1 * | 5/2004 | Laliberty | A63B 37/06 473/601 |
| 2005/0261083 | A1 * | 11/2005 | Liao | A63B 24/0021 473/353 |
| 2007/0021244 | A1 * | 1/2007 | Ko | A63B 43/06 473/570 |
| 2011/0275462 | A1 * | 11/2011 | Saegusa | A63B 37/0004 473/570 |
| 2012/0040785 | A1 * | 2/2012 | De Sort | A63B 43/06 473/570 |
| 2012/0071283 | A1 * | 3/2012 | Ou | A63B 37/12 473/597 |
| 2014/0194233 | A1 * | 7/2014 | Saegusa | A63B 37/00 473/570 |
| 2014/0221137 | A1 * | 8/2014 | Krysiak | G09B 19/0038 473/570 |
| 2014/0256478 | A1 * | 9/2014 | Gale | A63B 43/004 473/465 |
| 2015/0159858 | A1 * | 6/2015 | Lin | F21V 33/008 362/551 |
| 2015/0297954 | A1 * | 10/2015 | Smith | A63B 37/12 473/600 |
| 2016/0354665 | A1 * | 12/2016 | Greenwalt | A63B 69/0002 |

* cited by examiner

LUMINOUS BALL

BACKGROUND

1. Technical Field

The present disclosure relates to a luminous ball, in particular, to a luminous ball adapted to the baseball/softball game.

2. Description of Related Art

In order to let ball sports to undergo at night or in a dark environment, some luminous balls in the market serve a useful purpose in playing baseball or softball in the area where the lights are insufficient. However, the structure of the luminous ball needs to be largely changed for replacing the battery. A battery-size cut on the covering, for example, allows easy battery replacement, whereas the characteristics and specifications of the ball are changed accordingly, making the appearance and texture of luminous balls greatly different from that of regular baseballs or softballs.

In view of the aforementioned shortcomings, the present disclosure provides a luminous ball to resolve it.

SUMMARY

An object of the present invention is to provide a luminous ball that can overcome the aforementioned drawbacks.

According to one exemplary embodiment of the present disclosure, a luminous ball is provided, including a sphere, at least one covering, at least one thread and a light-emitting device. The sphere is made of a light-transmissive material. Ends of the covering are spliced to wrap an external circumferential surface of the sphere. At least one seam is formed on an edge of the covering, and a plurality of thread apertures are disposed in pairs at two sides of the at least one seam. At least one thread is connected with the plurality of thread apertures between the two sides of the at least one seam. The light-emitting device is disposed in the sphere and including a light-emitting unit, a power unit, and an electrical insulating unit used to break electrical connection between the light-emitting unit and the power unit. The electrical insulating unit is removable throughout the covering, and the electrical connection between the light-emitting unit and the power unit is provided when the electrical insulating unit is removed such that lights emitted by the light-emitting unit penetrate the sphere and are visible through the at least one seam and the plurality of thread apertures.

In a preferred embodiment of the present disclosure, the light-emitting unit includes at least one circuit board, and the at least one circuit board is provided with at least one light-emitting diode.

In a preferred embodiment of the present disclosure, the light-emitting unit includes circuit boards connected together, and each circuit board is provided with at least one light-emitting diode.

In a preferred embodiment of the present disclosure, the circuit boards amount to three, and the three circuit boards are connected to form a triangle.

In a preferred embodiment of the present disclosure, the power unit is a battery container containing a battery and having a case, a positive electrode sheet and a negative electrode sheet respectively disposed in the case, and the positive electrode sheet and the negative electrode sheet are configured to contact a cathode and an anode of the battery, respectively.

In a preferred embodiment of the present disclosure, the electrical insulating unit is a bolt-type insulator made of insulation material and having an insulated part and a pulling part connected to the insulated part which is made of a removable soft material and is paced between the positive electrode and the cathode of the battery, and the pulling part is left outside the covering.

In a preferred embodiment of the present disclosure, the light-emitting device further includes a vibration timing switch electrically connected between the light-emitting unit and the power unit and configured to detect vibration of the sphere after the electrical insulating unit is removed, and the vibration timing switch is turned on upon detecting vibration of the sphere to make the light-emitting unit emit while the vibration timing switch is turned off to make the light-emitting unit blank when no vibration of the sphere is detected after a preset period of time.

In a preferred embodiment of the present disclosure, the light-emitting device further includes a rolling-ball switch and a counter switch electrically connected to the rolling-ball switch which has a helical spring and a metal ball configured to roll back and forth inside the helical spring and to activate the counter switch to start counting a preset period of time when the metal ball contacts the positive electrode sheet, and the counter switch is turned off to make the light-emitting unit blank when the counter switch finishes counting the preset period of time.

In a preferred embodiment of the present disclosure, the pulling part is left outside the covering through one of the plurality of thread apertures.

In a preferred embodiment of the present disclosure, the sphere is made of a transparent elastic material.

In a preferred embodiment of the present disclosure, the sphere has at least two elastic layers having different elastic coefficients, and the at least two elastic layers are concentrically covered with each other to wrap the sphere.

In a preferred embodiment of the present disclosure, the sphere has a hollow part therein so as to adjust weight and elastic force of the sphere For the luminous ball provided by the present invention, the electrical insulating unit can break the electrical connection between the light-emitting unit and the power unit, whereas the in-between electrical connection is provided after removing the electrical insulating unit. Consequently, the luminous ball can be used as a normal baseball when the battery power runs out.

Moreover, making a battery-size cut on the covering of the luminous ball for battery replacement is unnecessary, and the covering of the luminous ball in the present invention therefore displays more similar characteristics in solidness, grain strength, tensile strength, resiliency, appearance and texture to those of regular baseballs or softballs.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
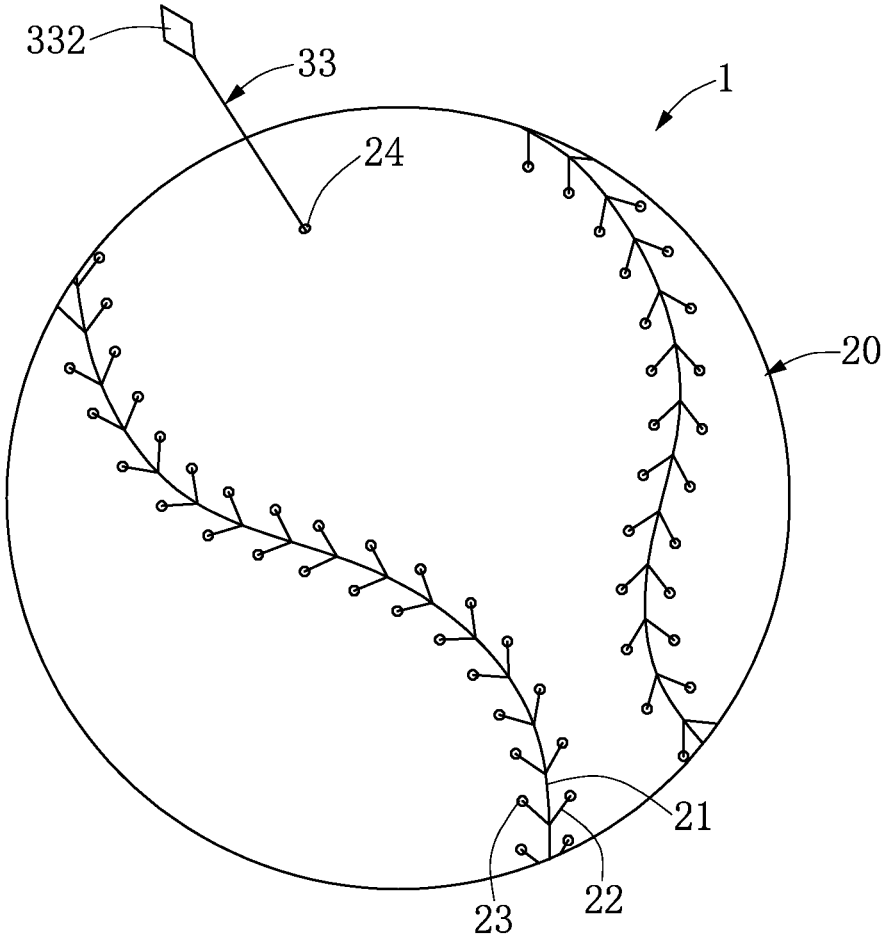
FIG. 1 is a three-dimensional diagram of the first embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

First Embodiment

Figure 2:
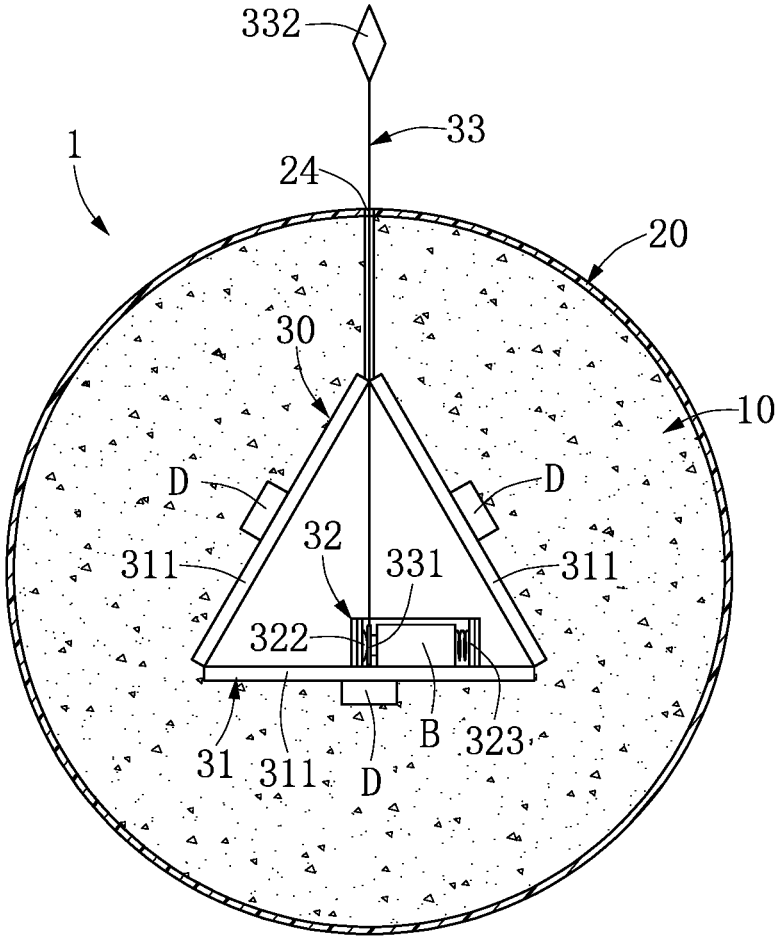
FIG. 2 is a sectional diagram of the first embodiment of the present disclosure.
Figure 3:
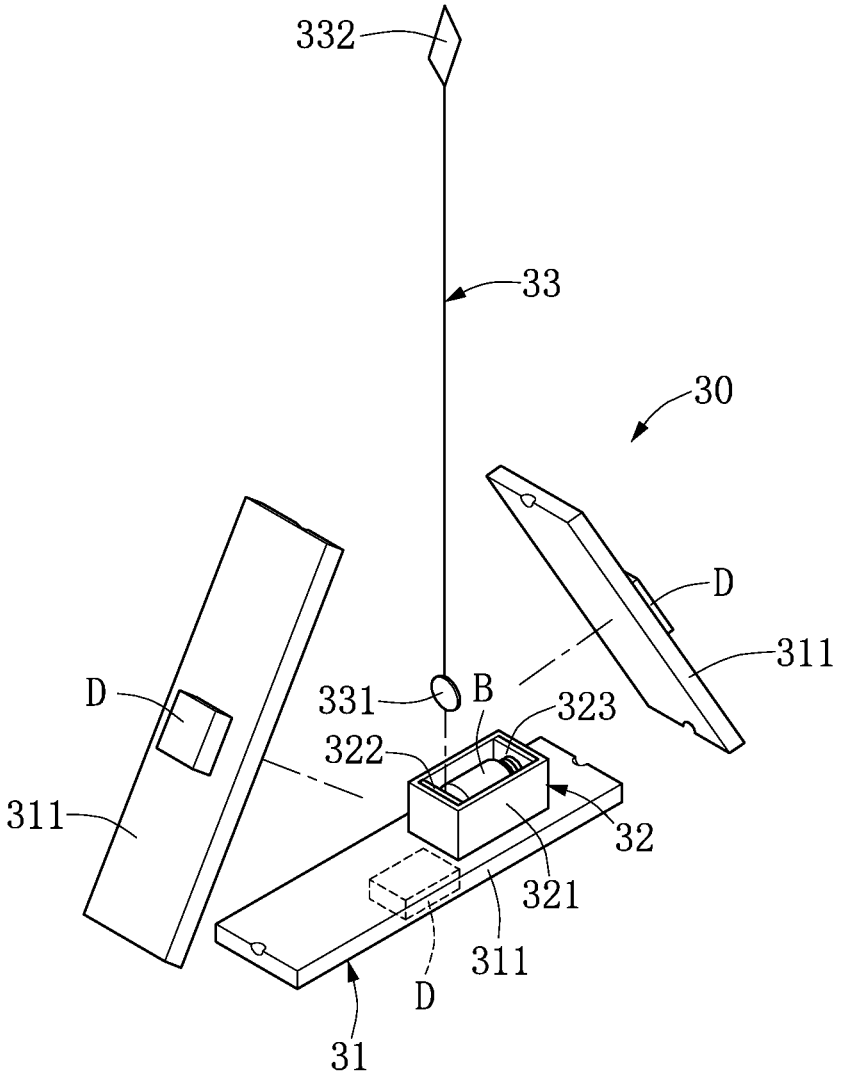
FIG. 3 is an exploded view of the light-emitting device of the first embodiment of the present disclosure.

Refer to FIG. 1 to FIG. 3. The luminous ball 1 provided by the present disclosure includes a sphere 10, at least one covering 20 wrapping an external circumferential surface of the sphere 10, and a light-emitting device 30 disposed in the sphere 10.

The sphere 10 can be made of but not limited to a transparent elastic material. In order to meet the standards of the regular sphere and conventional hard baseball or softball with a similar feel and hitting feeling, the sphere 10 is designed to have a similar diameter and material as the conventional hard baseball or softball, so that the sphere 10 of the luminous ball 1 can have the same weight and elastic coefficient as the regular baseball/softball. In some embodiments, the sphere 10 may be made of a soft material in order to form a safety ball.

The luminous ball 1 includes at least one covering 20, at least one seam 21 formed on an edge of the at least one covering 20, and a plurality of thread apertures 23 disposed in pairs at two sides of the at least one seam 21. Moreover, at least one thread 22 is provided to penetrate the plurality of thread apertures 23 to stitch the edge of the at least one covering 20 between the two sides of the at least one seam 21 to enable the at least one covering 20 to wrap the external circumferential surface of the sphere 10. The distribution path of the seam 21 and the thread 22 can be a distribution path of a baseball seam line. See e.g., FIG. 1.

The light-emitting device 30 includes a light-emitting unit 31, a power unit 32 used to supply electrical power, and an electrical insulating unit 33 used to break electrical connection between the light-emitting unit 31 and the power unit 32.

The light-emitting unit 31 includes at least one circuit board 311, at least one light-emitting diode D, and electrical circuits controlling the light-emitting diode D. In the preferred mode, the light-emitting unit 31 includes three circuit boards 311 with the same shape which can be preassembled in a manner similar to the panelization in order to reduce costs. In addition, these three circuit boards 311 are connected to form a triangle where at least one light-emitting diode D is disposed at the outer surface of each circuit board 311 to provide omnidirectional light extraction.

In some embodiments, the light-emitting unit 31 may include four circuit boards 311 with the same shape which are connected to form a rectangle. Therefore, the structure of the light-emitting unit 31 described above is merely one of specific applications of the present invention, showing that the structure of the light-emitting unit 31 can be freely changed as required.

Electrical connection between the power unit 32 and the light-emitting unit 31 is selectively provided, enabling the power unit 32 to supply electrical power to the light-emitting unit 31. In the preferred mode, the power unit 32 is a battery container containing a battery B and can be fixed to either the inner surface of any circuit board 311 of the light-emitting unit 31 or any appropriate place inside the sphere 10. Specifically, the power unit 32 has a case 321, a positive electrode sheet 322 and a negative electrode sheet 323. Inside the case 321, the positive electrode sheet 322 is used to contact the cathode of the battery B and the negative electrode sheet 322 is used to contact the anode of the battery B. The specifications, numbers and arrangement of the battery B are not regulated. In this embodiment, the battery B, for example, is a button cell (LR50).

The electrical insulating unit 33 is removable throughout the covering 20. The electrical insulating unit 33 is a bolt-type insulator made of insulation material, having an insulated part 331 and a pulling part 332 connected to the insulated part 331. The insulated part 331 made of a removable soft material is placed between the positive electrode plate 322 and the cathode of the battery B, preventing the battery B from supplying battery power to the light-emitting unit 31, that is, breaking the electrical connection between the light-emitting unit 31 and the power unit 32.

The pulling part 332 is left outside the covering 20. A tiny through-hole 24 is formed on the covering 20 to allow the electrical insulating unit 33 to pass through the covering 20. In addition, by pulling the pulling part 332, the insulated part 331 of the electrical insulating unit 33 can be pulled off from the light-emitting unit 31. When the insulated part 331 is pulled off, the positive electrode plate 322 contacts the cathode of the battery B, enabling the electric current flow between the light-emitting unit 31 and the power unit 32 and making the electrical connection between the light-emitting unit 31 and the power unit 32. Then the battery B is able to supply battery power to the light-emitting unit 31, and the lights are emitted outwardly from each light-emitted diode D. As the sphere 10 is made of the light-transmissive material, the lights emitted by the light-emitting device 30 can penetrate the sphere 10. As the covering 20 is made of an opaque genuine leather material, the lights are incapable of penetrating the covering 20. Because there is at least one seam 21 and thread aperture 23 disposed on the covering 20, the lights are visible through the at least one seam 21 and thread aperture 23. By means of the seam 21 and thread aperture 23, the luminous ball of the present disclosure is suitable to be employed in dim light at night and for night-time use. In addition, the user can clearly see the motion trajectory and rotation path of the luminous ball 1 through the lights which are visible through the seam 21 and thread aperture 23 of the luminous ball 1. Moreover, when the luminous ball 1 runs out of battery power, it can be used as a normal baseball.

Making a battery-size cut on the covering 20 of the luminous ball 1 for battery replacement is unnecessary, and the covering 20 of the luminous ball 1 in the present invention therefore displays more similar characteristics in solidness, grain strength, tensile strength, resiliency, appearance and texture to those of regular baseballs or softballs, thereby enabling the luminous ball 1 to be employed in formal baseball/softball games or training.

Second Embodiment

Figure 4:
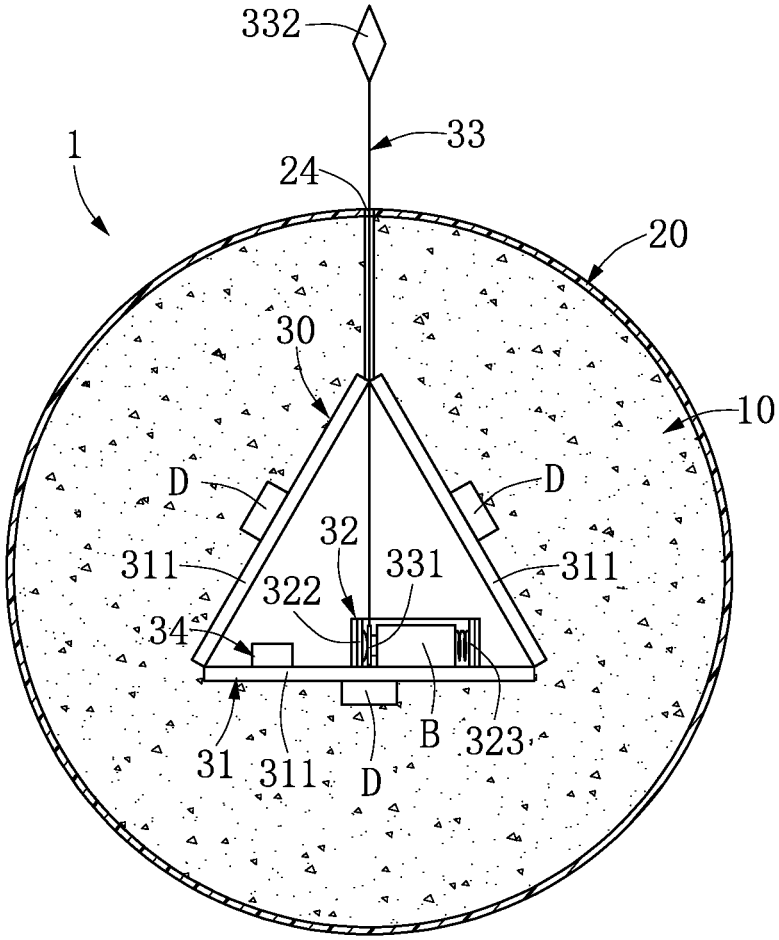
FIG. 4 is a sectional diagram of the second embodiment of the present disclosure.

Refer to FIG. 4. To extend battery B life after the electrical insulating unit 33 is removed from the light-emitting device 30, a vibration timing switch 34 is provided to the light-emitting device 30 in this embodiment. The vibration timing switch 34 is electrically connected between the light-emitting unit 31 and the power unit 32. The vibration timing switch 34 is configured to detect vibration of the sphere 10 after the electrical insulating unit 33 is removed. The switch 34 is turned on upon detecting vibration of the sphere 10 to make each light-emitting diode D emit while the switch 34 is turned off to make each light-emitting diode D blank when no vibration of the sphere 10 is detected after a preset period of time. In this way, the vibration of the sphere 10 triggers the vibration timing switch 34 to connect battery power, enabling each light-emitting diode D to emit; when the sphere 10 stops vibrating after a preset period of time, the vibration timing switch 34 becomes off to disconnect battery power and turn off each light-emitting diode D so that the battery B life can be effectively extended.

Third Embodiment

Figure 5:
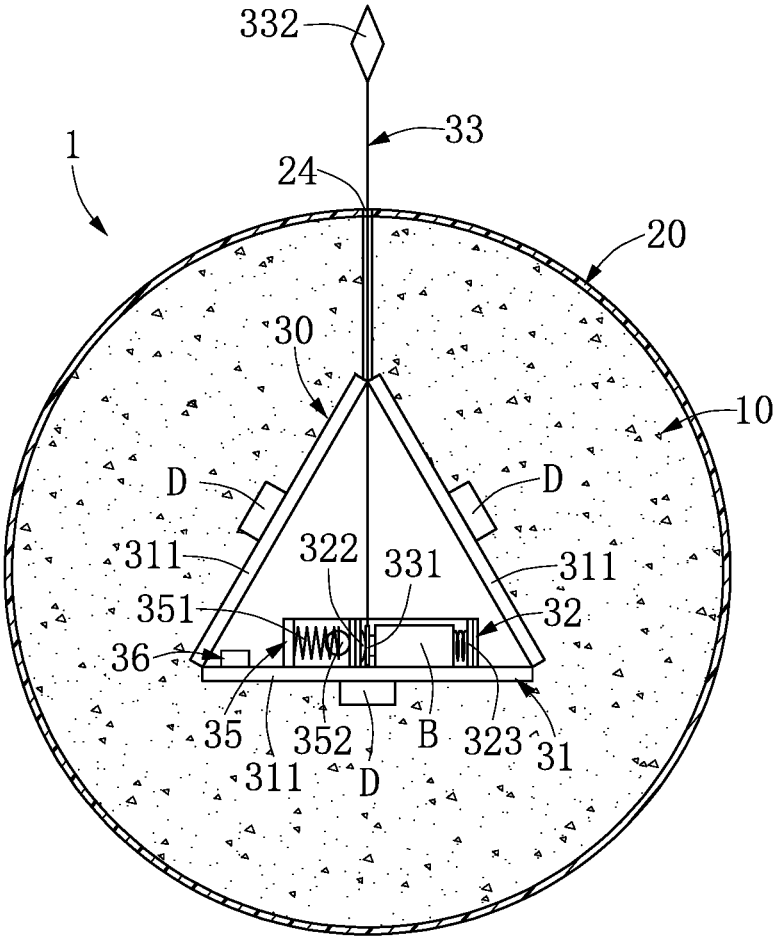
FIG. 5 is a sectional diagram of the third embodiment of the present disclosure.

FIG. 5 illustrates the third embodiment of the present disclosure. The difference between the second and the third embodiments is that the light-emitting device 30 includes a rolling-ball switch 35 and a counter switch 36 electrically connected to the rolling-ball switch 35. The rolling-ball switch 35 is configured to activate the counter switch 36. Specifically, the rolling-ball switch 35 has a helical spring 351 and a metal ball 352 configured to roll back and forth inside the helical spring 351. One end of the helical spring 351 connects to a circuit on the circuit board 311 for electrical power while the other end cases the metal ball 352. The inner diameter of the helical spring 351 is greater than the outer diameter of the metal ball 352, allowing the metal ball 352 rolling back and forth inside the helical spring 351. When the rolling metal ball 352 contacts the positive electrode sheet 322, the counter switch 36 is powered on to start counting a preset period of time, and the counter switch 36 is turned off to make the light-emitting diode D blank when the counter switch 36 finishes counting the preset period of time. In this way, the rolling of the sphere 10 triggers the counter switch 36 to start counting, and each light-emitting diode D is turned off when the counter switch 36 finishes counting so that the battery B life can be effectively extended.

Fourth Embodiment

Figure 6:
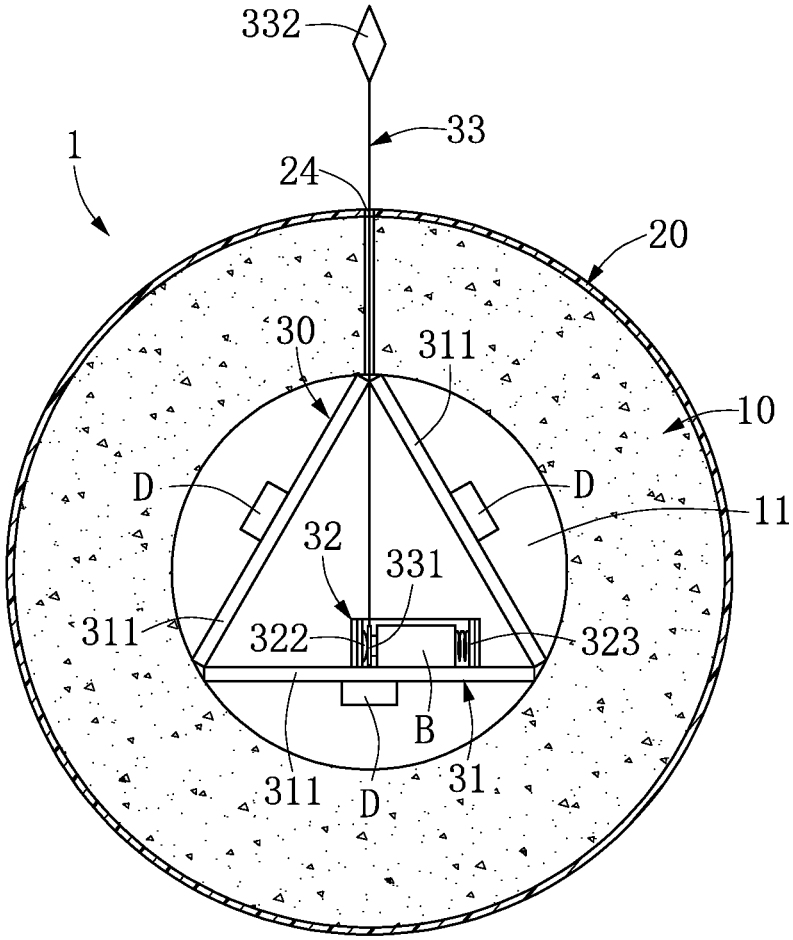
FIG. 6 is a sectional diagram of the fourth embodiment of the present disclosure.

FIG. 6 illustrates the fourth embodiment of the present disclosure. In the present embodiment, a hollow part 14 is disposed in the central portion of the sphere 10, wherein the hollow part 14 is used to adjust the weight and elastic force of the sphere 10, thereby enabling the sphere 10 to have the weight and elastic force that are the same as the regular baseball/softball.

Fifth Embodiment

Figure 7:
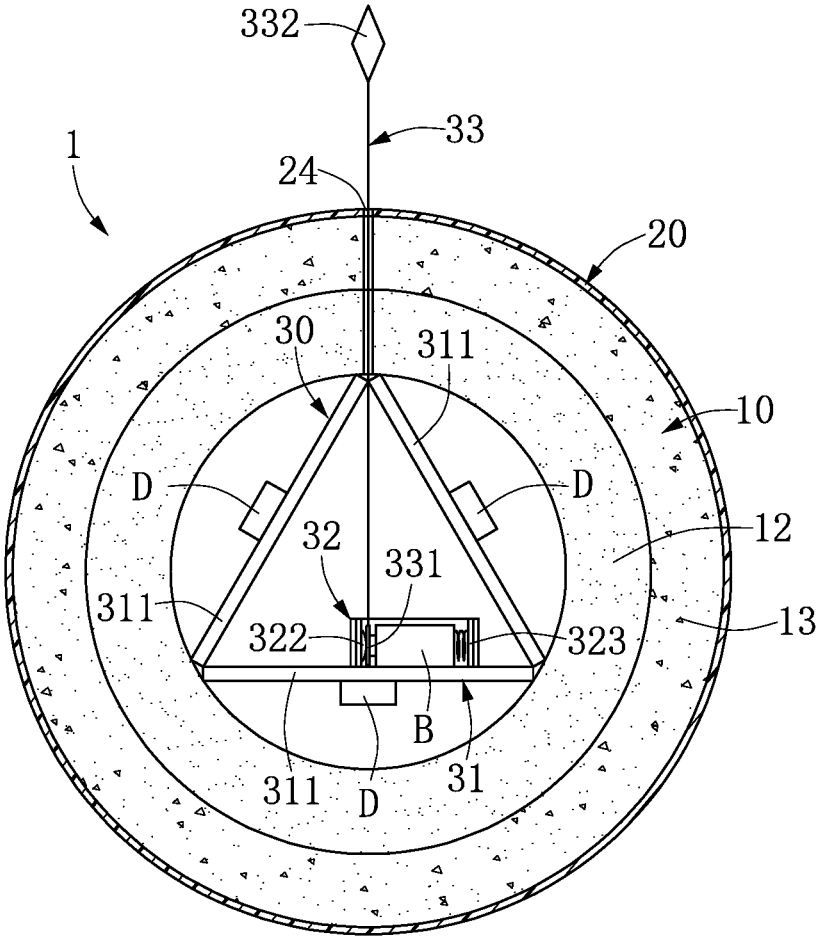
FIG. 7 is a sectional diagram of the fifth embodiment of the present disclosure.

FIG. 7 illustrates the fifth embodiment of the present disclosure. In the present embodiment, the sphere 10 is made of a plurality of elastic layers, wherein the plurality of elastic layers include a first elastic layer 12 and a second elastic layer 13. The first elastic layer 12 and the second elastic layer 13 are concentrically covered with each other to form the sphere 10, and the first elastic layer 12 and the second elastic layer 13 may be made of the materials having different elastic coefficients and weights, thereby enabling the luminous ball of the present disclosure to have the same weight and elastic force as a regular baseball/softball. Here, the number of the elastic layers shown in FIG. 7 is used as an exemplary embodiment, and the present disclosure is not limited thereto.

Sixth Embodiment

Figure 8:
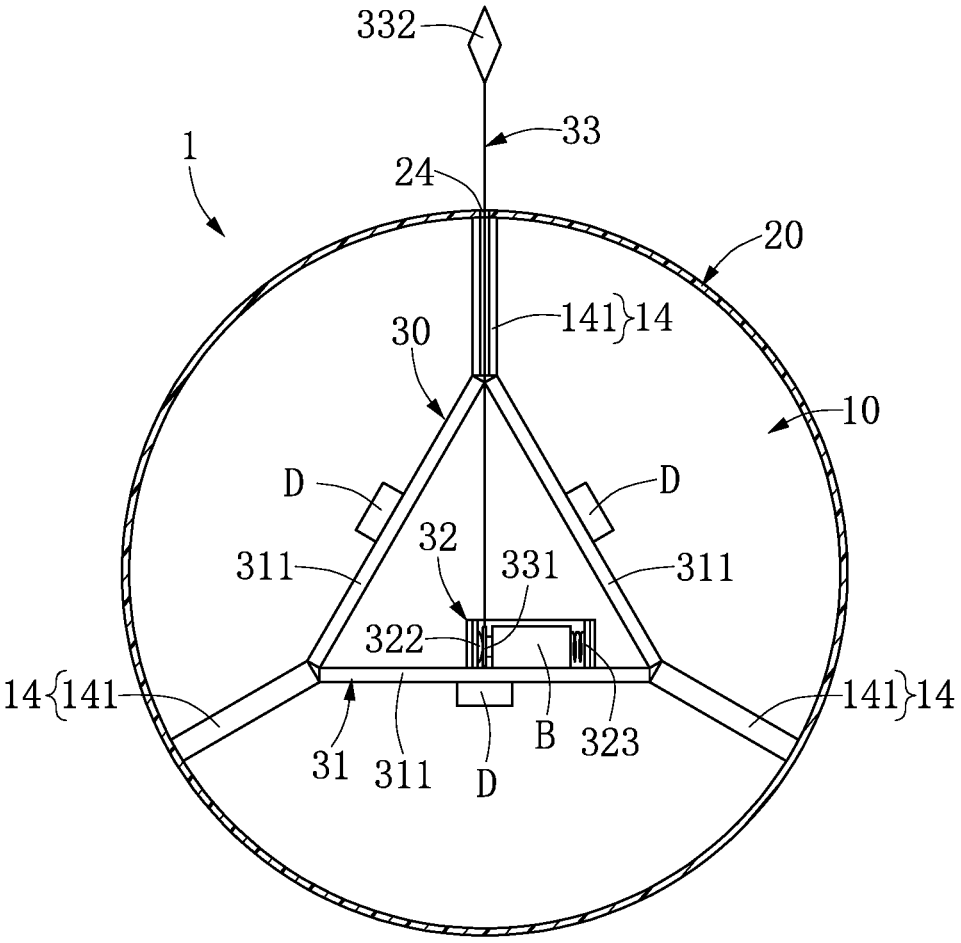
FIG. 8 is a sectional diagram of the sixth embodiment of the present disclosure.

FIG. 8 illustrates the sixth embodiment of the present disclosure. In the present embodiment, the sphere 10 is hollow and has a support structure 14 disposed therein. The support structure 14 is configured to support the light emitting device 30 at the central portion of the sphere 10. Specifically, the support structure 14 includes a plurality of support columns 141. One end of each support column 141 is connected to the light emitting device 30 and the other end is connected to the inner wall of the sphere 10 so that the light emitting device 30 can be supported at the central portion of the sphere 10.

Seventh Embodiment

Figure 9:
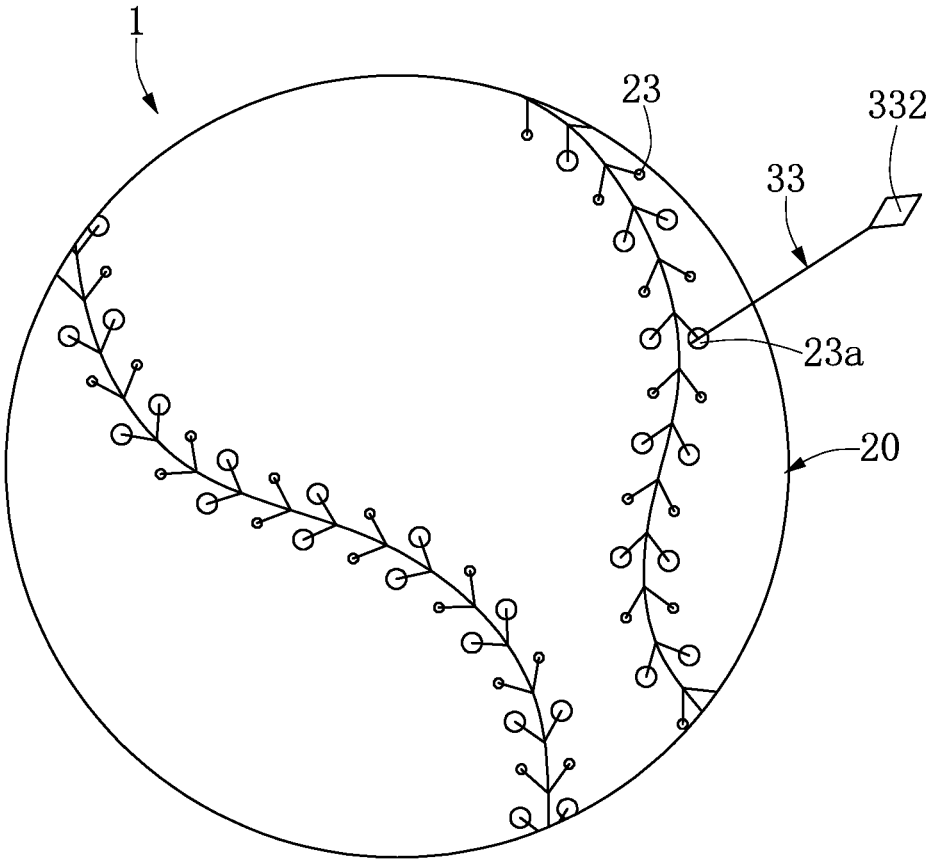
FIG. 9 is a three-dimensional diagram of the seventh embodiment of the present disclosure.

FIG. 9 illustrates the seventh embodiment of the present disclosure. In the present embodiment, the plurality of the thread apertures 23 are partially replaced by a plurality of thread apertures **23*a*, wherein each of the thread apertures 23*a* has a bigger diameter than that of each of the thread apertures 23, and the pulling part 332 of the electrical insulating unit 33 is exposed by one of the thread apertures 23*a*, so that forming a through-hole 24 (shown in FIG. 1) on the covering 20** is unnecessary.

Eighth Embodiment

Figure 10:
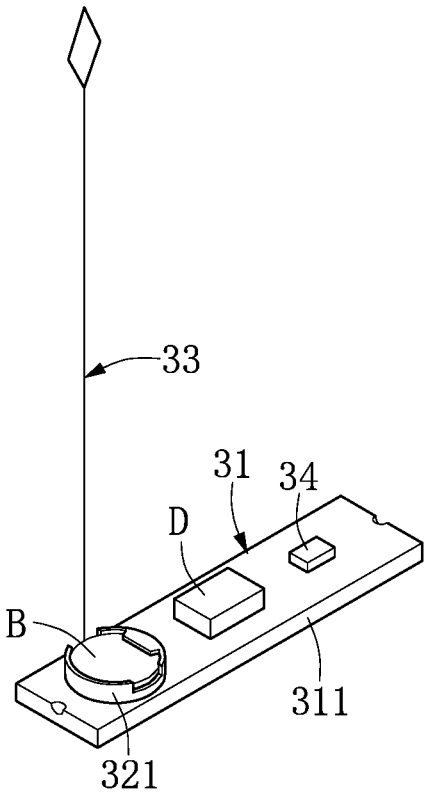
FIG. 10 is a three-dimensional diagram view of the light-emitting device of the eighth embodiment of the present disclosure.

FIG. 10 illustrates the eighth embodiment of the present disclosure. In the present embodiment, the light emitting unit 31 may have only one circuit board 311, and a battery B, a light emitting diode D and a vibration timing switch 34 are disposed at the circuit board 311. Certainly, the light emitting unit 31 may have three circuit boards 311, and each circuit board 311 is provided with a battery B, a light emitting diode D and a vibration timing switch 34. Preferably, the battery B is, for example, a button cell (CR2032).

Ninth Embodiment

Figure 11:
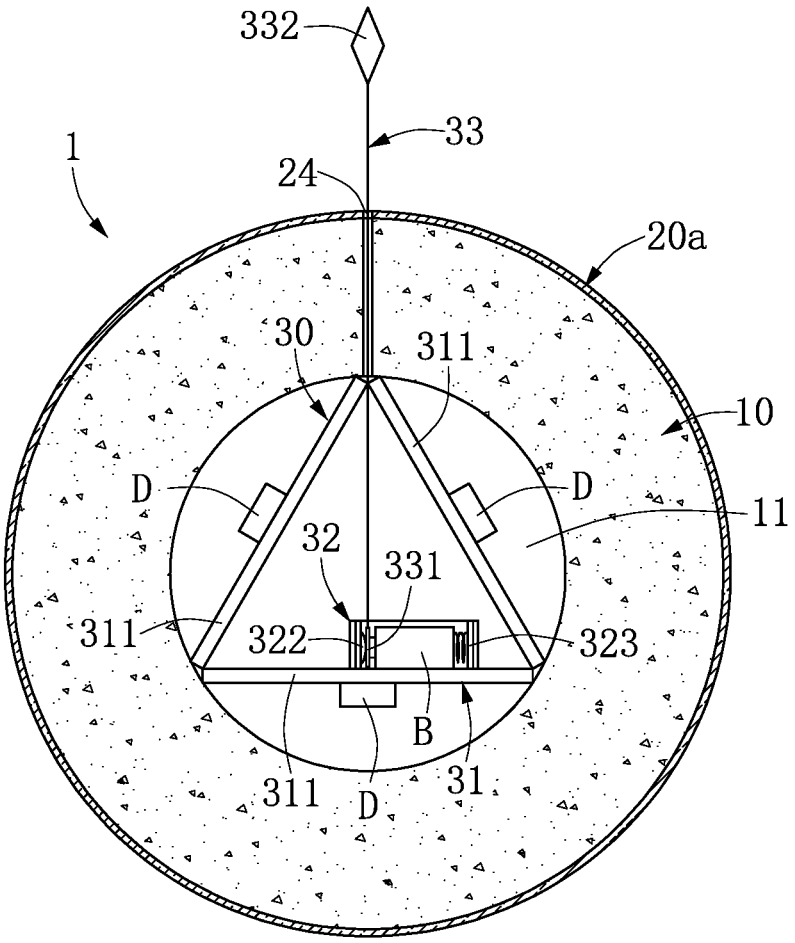
FIG. 11 is a sectional diagram of the ninth embodiment of the present disclosure.

FIG. 11 illustrates the ninth embodiment of the present disclosure. In the present embodiment, the covering 20*a* of the luminous ball 1 is made of a transparent material or a light-transmissive synthetic leather.

Tenth Embodiment

Figure 12:
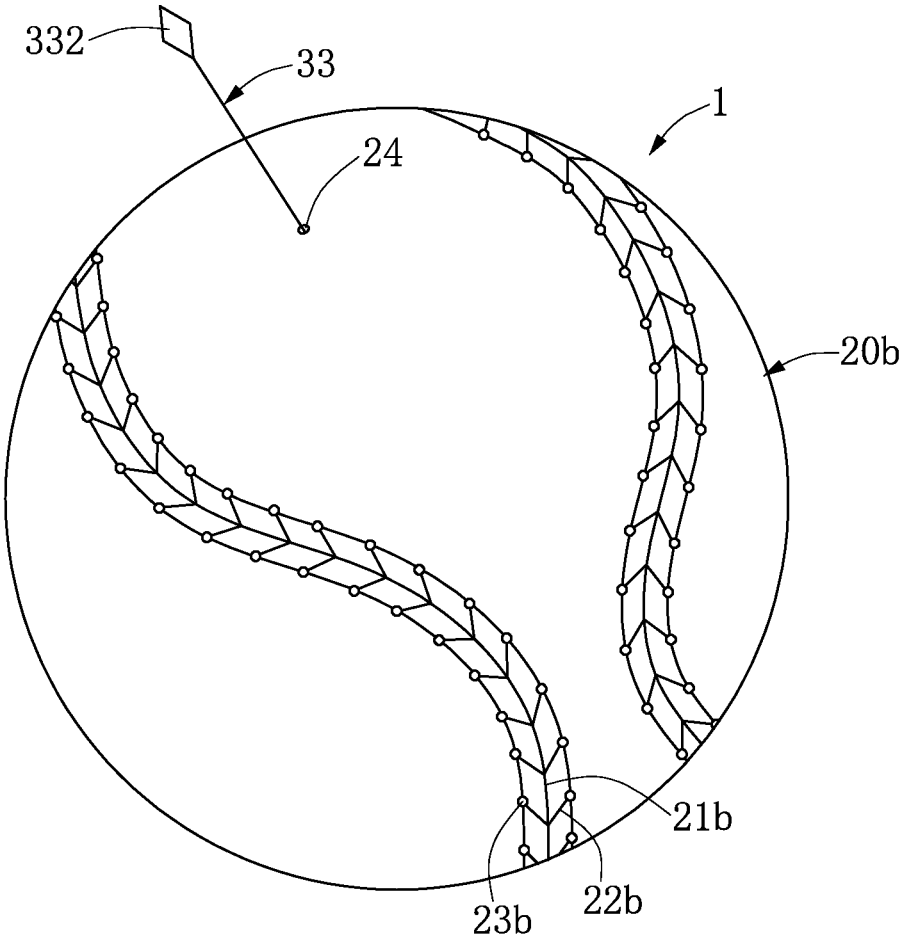
FIG. 12 is a three-dimensional diagram of the tenth embodiment of the present disclosure.

FIG. 12 illustrates the tenth embodiment of the present disclosure. In the present embodiment, the seam 21*b*, the thread 22*b* and the thread apertures 23*b* are simulated and are formed integrally on the surface of the covering 20*b* or the sphere by etching or embossing, thus allowing the simulated seam 21*b*, thread 22*b* and thread apertures 23*b* to present the same appearance and feel to the player.

Eleventh Embodiment

Figure 13:
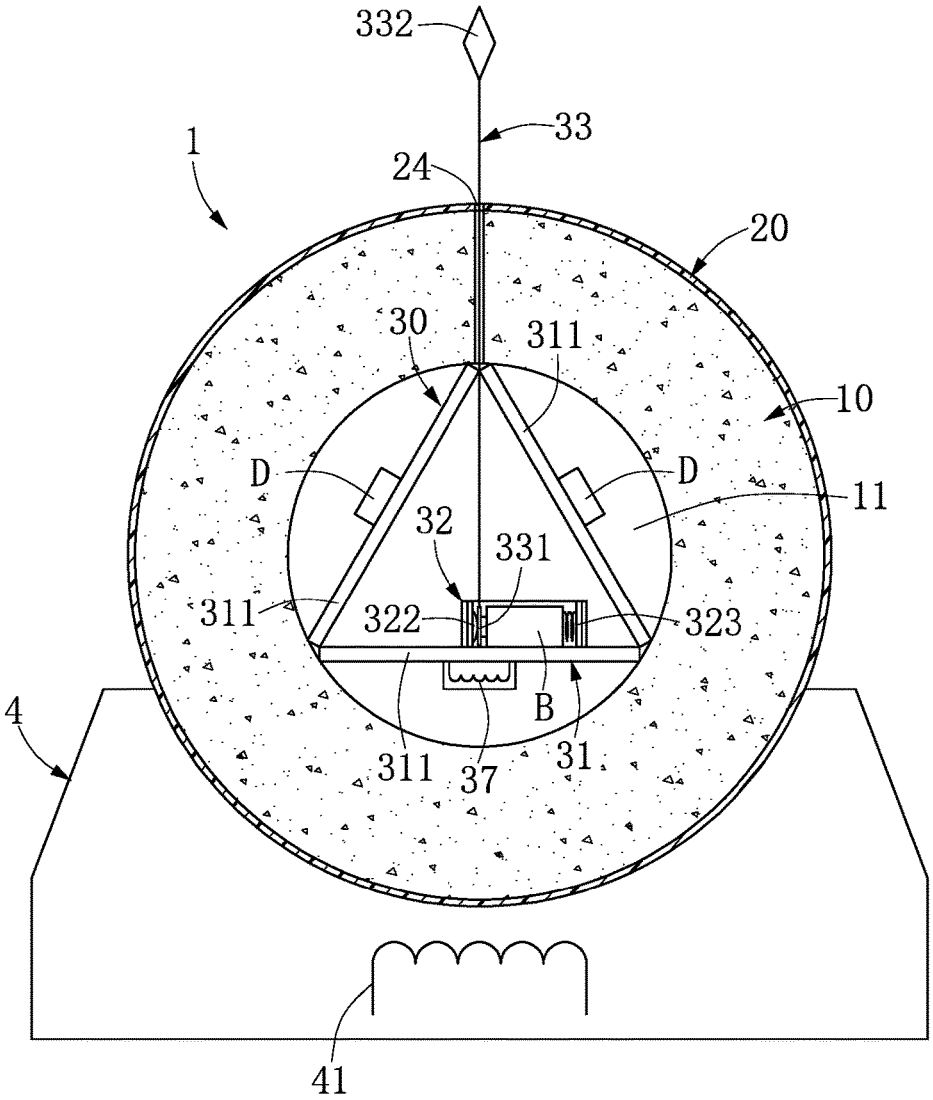
FIG. 13 is a sectional diagram of the eleventh embodiment of the present disclosure.

FIG. 13 illustrates the eleventh embodiment of the present disclosure. In the present embodiment, the lower surface of the circuit board 311 of the light-emitting device 30 is provided with an induction coil 37 for wirelessly receiving power to replenish the battery B. In detail, the induction coil 37 is electrically connected to the battery B and is capable of being wirelessly connected to the transmission coil 41 of the wireless charger 4. Therefore, when the luminous ball 1 is placed on the wireless charger 4, the transmitting coil 41 can wirelessly transmit power to the induction coil 37 using inductive coupling, and the induction coil 37 can wirelessly receive power to replenish the battery B, thus allowing the battery B to obtain sufficient power.

In summary, the electrical insulating unit 33 is a bolt-type insulator used to break the electrical connection between the light-emitting unit 31 and the power unit 32, whereas the in-between electrical connection is provided after removing the electrical insulating unit 33. Consequently, the luminous ball 1 can be used as a normal baseball when the battery B runs out. Moreover, making a battery-size cut on the covering 20 of the luminous ball 1 for battery replacement is unnecessary, and the covering 20 of the luminous ball 1 in the present invention therefore displays more similar characteristics in solidness, grain strength, tensile strength, resiliency, appearance and texture to those of regular baseballs or softballs, thereby enabling the luminous ball to be employed in formal baseball/softball games or training.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A luminous ball, comprising:

a sphere made of a light-transmissive material;

at least one covering of which ends are spliced to wrap an external circumferential surface of the sphere, at least one seam formed on an edge of the covering, and a plurality of thread apertures disposed in pairs at two sides of the at least one seam;

at least one thread connected with the plurality of thread apertures between the two sides of the at least one seam; and a light-emitting device disposed in the sphere and including a light-emitting unit, a power unit and an electrical insulating unit breaking an electrical connection between the light-emitting unit and the power unit, wherein the electrical insulating unit is removable throughout the covering, and the electrical connection between the light-emitting unit and the power unit is provided when the electrical insulating unit is removed such that lights emitted by the light-emitting unit penetrate the sphere and are visible through the at least one seam and the plurality of thread apertures, wherein the light-emitting unit includes circuit boards connected together, each circuit board is provided with at least one light-emitting diode, the circuit boards amount to three, and the three circuit boards are connected to form a triangle.

2. The luminous ball according to claim 1, wherein the power unit is a battery container containing a battery and having a case, a positive electrode sheet and a negative electrode sheet respectively disposed in the case, and the positive electrode sheet and the negative electrode sheet are configured to contact a cathode and an anode of the battery, respectively.

3. The luminous ball according to claim 2, wherein the electrical insulating unit is a bolt-type insulator made of insulation material and having an insulated part and a pulling part connected to the insulated part which is made of a removable soft material and is placed between the positive electrode and the cathode of the battery, and the pulling part is left outside the covering.

4. The luminous ball according to claim 3, wherein the light-emitting device further includes a vibration timing switch electrically connected between the light-emitting unit and the power unit and configured to detect vibration of the sphere after the electrical insulating unit is removed, and the vibration timing switch is turned on upon detecting vibration of the sphere to make the light-emitting unit emit while the vibration timing switch is turned off to make the light-emitting unit blank when no vibration of the sphere is detected after a preset period of time.

5. The luminous ball according to claim 3, wherein the light-emitting device further includes a rolling-ball switch and a counter switch electrically connected to the rolling-ball switch which has a helical spring and a metal ball configured to roll back and forth inside the helical spring and to activate the counter switch to start counting a preset period of time when the metal ball contacts the positive electrode sheet, and the counter switch is turned off to make the light-emitting unit blank when the counter switch finishes counting the preset period of time.

6. The luminous ball according to claim 3, wherein the pulling part is left outside the covering through one of the plurality of thread apertures.

7. The luminous ball according to claim 1, wherein the sphere is made of a transparent elastic material.

8. The luminous ball according to claim 1, wherein the sphere has at least two elastic layers having different elastic coefficients, and the at least two elastic layers are concentrically covered with each other to wrap the sphere.

9. The luminous ball according to claim 1, wherein the sphere has a hollow part therein so as to adjust weight and elastic force of the sphere.

10. The luminous ball according to claim 1, wherein the covering of the luminous ball is made of a light-transmissive synthetic leather.

11. The luminous ball according to claim 1, wherein the seam, the thread and the plurality of thread apertures are simulated and are formed integrally on a surface of the covering.

12. The luminous ball according to claim 1, wherein at least one of the circuit boards of the light-emitting device is provided with an induction coil electrically connected to the power unit and capable of being wirelessly connected to a transmission coil of a wireless charger, such that the power unit is capable of being wirelessly replenished with power when the luminous ball is placed on the wireless charger.

* * * * *